US007878865B2

(12) United States Patent
Desrosiers et al.

(10) Patent No.: US 7,878,865 B2
(45) Date of Patent: Feb. 1, 2011

(54) LOCKING CONNECTOR FOR ENGAGING A USB RECEPTACLE

(75) Inventors: Norman B. Desrosiers, Oxford, NC (US); Dean F. Herring, Youngsville, NC (US); Paul D. Kangas, Cary, NC (US); Jeff D. Thomas, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/479,946

(22) Filed: Jun. 8, 2009

(65) Prior Publication Data

US 2010/0311283 A1 Dec. 9, 2010

(51) Int. Cl.
*H01R 13/64* (2006.01)

(52) U.S. Cl. ..... 439/680

(58) Field of Classification Search ..... 439/680, 439/352, 567, 638, 357–358, 76.1
See application file for complete search history.

(56) References Cited

U.S. PATENT DOCUMENTS

| | | | | |
|---|---|---|---|---|
| 6,056,578 | A | 5/2000 | Lin | |
| 6,273,757 | B1 | 8/2001 | David et al. | |
| 6,854,984 | B1 | 2/2005 | Lee et al. | |
| 6,902,432 | B2 | 6/2005 | Morikawa et al. | |
| 7,037,129 | B2 | 5/2006 | Lo et al. | |
| 7,094,099 | B2 | 8/2006 | Daggett et al. | |
| 7,128,595 | B2 | 10/2006 | Boutros | |
| 7,241,153 | B2 * | 7/2007 | He et al. | 439/148 |
| 7,270,560 | B1 | 9/2007 | Bodmann et al. | |
| 7,303,438 | B2 * | 12/2007 | Dawiedczyk et al. | 439/607.53 |
| 7,479,021 | B2 * | 1/2009 | Huang | 439/133 |
| 7,607,950 | B2 * | 10/2009 | Liao | 439/638 |
| 2005/0250369 | A1 | 11/2005 | Ferderer | |
| 2008/0057785 | A1 | 3/2008 | Huang | |

* cited by examiner

*Primary Examiner*—Jean F Duverne
(74) *Attorney, Agent, or Firm*—Edward J. Lenart; Tom Tyson; Biggers and Ohanian, LLP

(57) ABSTRACT

A locking connector for engaging a Universal Serial Bus ("USB") receptacle, including: a connector housing having a locking cam opening on one side of the connector housing, the connector housing split along a longitudinal axis of the locking connector forming a connector housing gap on the same side of the connector housing as the locking cam opening; a locking cam surface positioned within the locking cam opening in contact with the connector housing; and a pivotable locking cam actuating lever connected to a top of the locking cam surface, the locking cam actuating lever having a locked position and an unlocked position, the locking cam surface in a rotated position expanding the connector housing when the cam actuating lever is in the locked position, the locking cam surface in a relaxed position with the connector housing not expanded when the cam actuating lever is in the unlocked position.

8 Claims, 9 Drawing Sheets

LOCKING CONNECTOR FOR ENGAGING A USB RECEPTACLE

BACKGROUND OF THE INVENTION

1. Field of the Invention

The field of the invention is connectors for Universal Serial Bus ("USB") devices.

2. Description of Related Art

Universal Serial Bus ('USB') is a serial bus standard to interface devices. USB can connect computer peripherals such as mouse devices, keyboards, PDAs, gamepads and joysticks, scanners, digital cameras and printers. USB was designed to allow peripherals to be connected using a single standardized interface socket to improve plug-and-play capabilities by allowing devices to be connected and disconnected without rebooting the computer. Computers having connected USB peripheral devices may be moved or shipped causing unintentional disconnection of those USB peripheral devices.

SUMMARY OF THE INVENTION

A locking connector for engaging a Universal Serial Bus ("USB") receptacle is provided, the locking connector disposed partially within the USB receptacle. The locking connector includes: a connector housing having a locking cam opening on one side of the connector housing, the connector housing split along a longitudinal axis of the locking connector forming a connector housing gap on the same side of the connector housing as the locking cam opening; a locking cam surface positioned within the locking cam opening in contact with the connector housing; and a pivotable locking cam actuating lever connected to a top of the locking cam surface, the locking cam actuating lever having a locked position and an unlocked position, the locking cam surface in a rotated position expanding the connector housing when the cam actuating lever is in the locked position, the locking cam surface in a relaxed position with the connector housing not expanded when the cam actuating lever is in the unlocked position.

The foregoing and other objects, features and advantages of the invention will be apparent from the following more particular descriptions of example embodiments of the invention as illustrated in the accompanying drawings wherein like reference numbers generally represent like parts of example embodiments of the invention.

DETAILED DESCRIPTION OF EXAMPLE EMBODIMENTS

Figure 1:
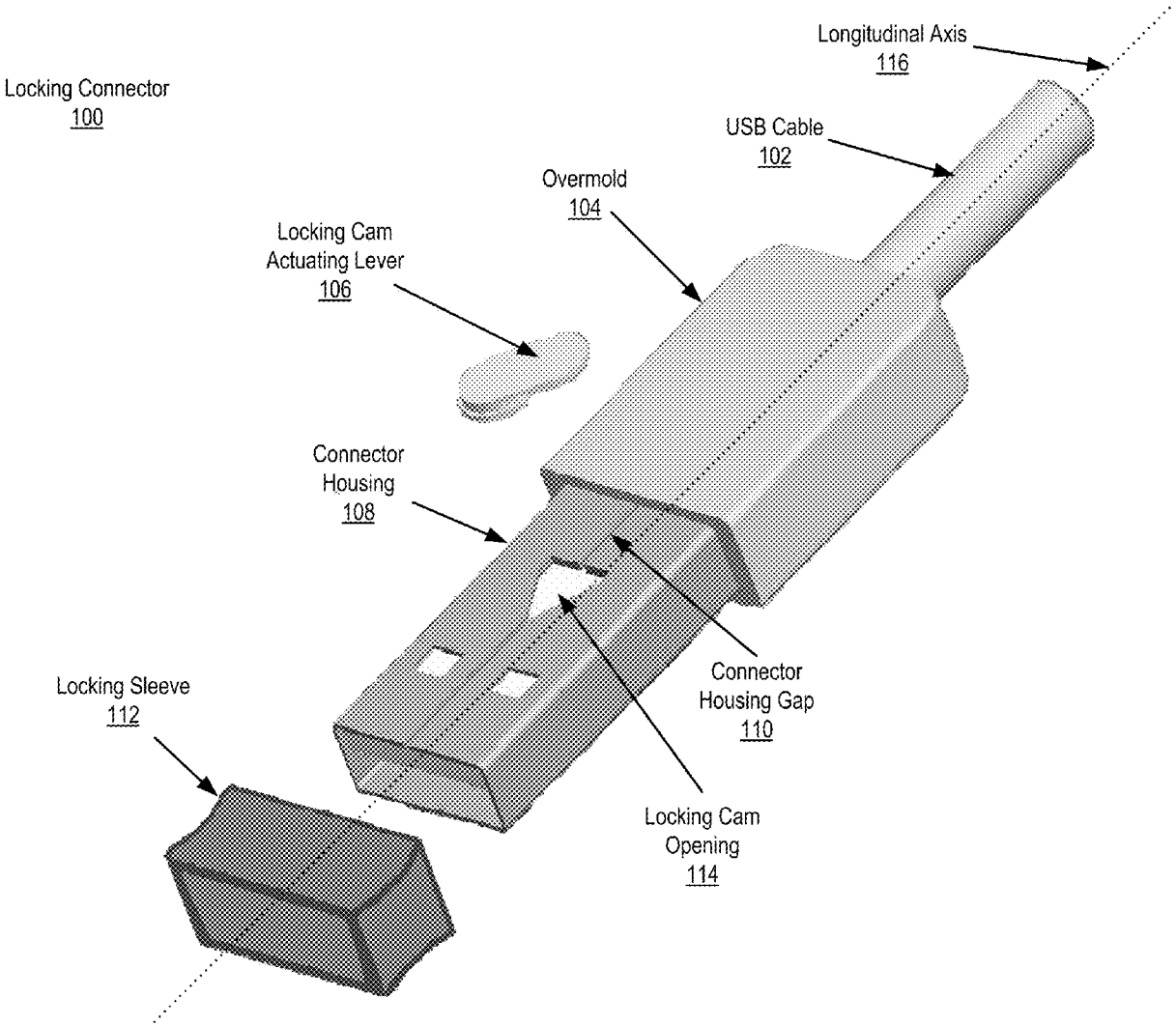
FIG. 1 sets forth a diagram of an example embodiment of a locking connector for engaging a USB receptacle according to the present invention.

Example locking connectors for engaging a USB receptacle, methods for locking USB locking connectors engaged with USB receptacles, and methods of manufacturing locking connectors engaged with USB receptacles in accordance with the present invention are described with reference to the accompanying drawings, beginning with FIG. 1. FIG. 1 sets forth a diagram of an example embodiment of an unassembled locking connector (100) for engaging a USB receptacle according to the present invention. The locking connector (100) in the example of FIG. 1 is capable of engaging a Universal Serial Bus ("USB") receptacle (502 of FIG. 5).

The USB receptacle may be connected to a computer (not shown) or any USB-enabled device.

The example locking connector (100) of FIG. 1 is attached to a USB cable (102). The example of a USB cable (102) in the specification is for example only and not for limitation. For example, a locking connector according to another embodiment of the present invention is attached to a USB memory stick, also called a keydrive or "flash" drive. Examples of USB devices that may be connected to computers through locking receptacles according to the present invention include mouse devices, keyboards, personal digital assistants ('PDAs'), gamepads and joysticks, scanners, digital cameras, printers and many more as will occur to those of skill in the art.

The locking connector (100) engages the USB receptacle (502 in FIG. 5) and is disposed partially within the USB receptacle. Overmold (104) is positioned to protect the upper of the locking connector (100) between the connector housing (108) and the USB cable (102) and may be manufactured of a rubber, plastic, or other material as may occur to one skilled in the art.

The locking connector (100) includes a connector housing (108) covering the electrical connectors (not shown) that enable communication between USB devices. The connector housing (108) includes a locking cam opening (114) on one side of the connector housing (108). In the example embodiment of FIG. 1, the locking cam opening (114) substantially forms the shape of an isosceles triangle—that is, two vertices of substantially the same length, and the third vertex shorter than the first two. In the example embodiment of FIG. 1, the top side of locking cam opening (114) is shorter than the other two sides. The connector housing (108) is split along the longitudinal axis (116) of locking connector (100), forming a connector housing gap (110) on the same side of the connector housing as the locking cam opening (114). The connector housing gap (110) allows for expansion of the connector housing (108) within the USB receptacle to increase friction between the connector housing gap (108) and the inside of the USB receptacle. Connector housing (108) may be made of a thin metal or any other somewhat flexible material as will occur to those of skill in the art. According to some embodiments of the present invention the sides of locking connector housing (108) are dimpled, serrated, or otherwise textured to further increase friction between the connector housing (108) and the inside of the USB receptacle.

Locking connector (100) further includes a locking cam actuating lever (106) having an unlocked position and a locked position. The example locking cam actuating lever (106) includes a flat blade with a rounded tip that slides along a surface of the connector housing (108). One of skill in the art will appreciate, however, that a locking cam actuating lever according to the present application may be implemented in a number of alternative shapes and sizes as will occur to one of skill in the art.

Figure 2:
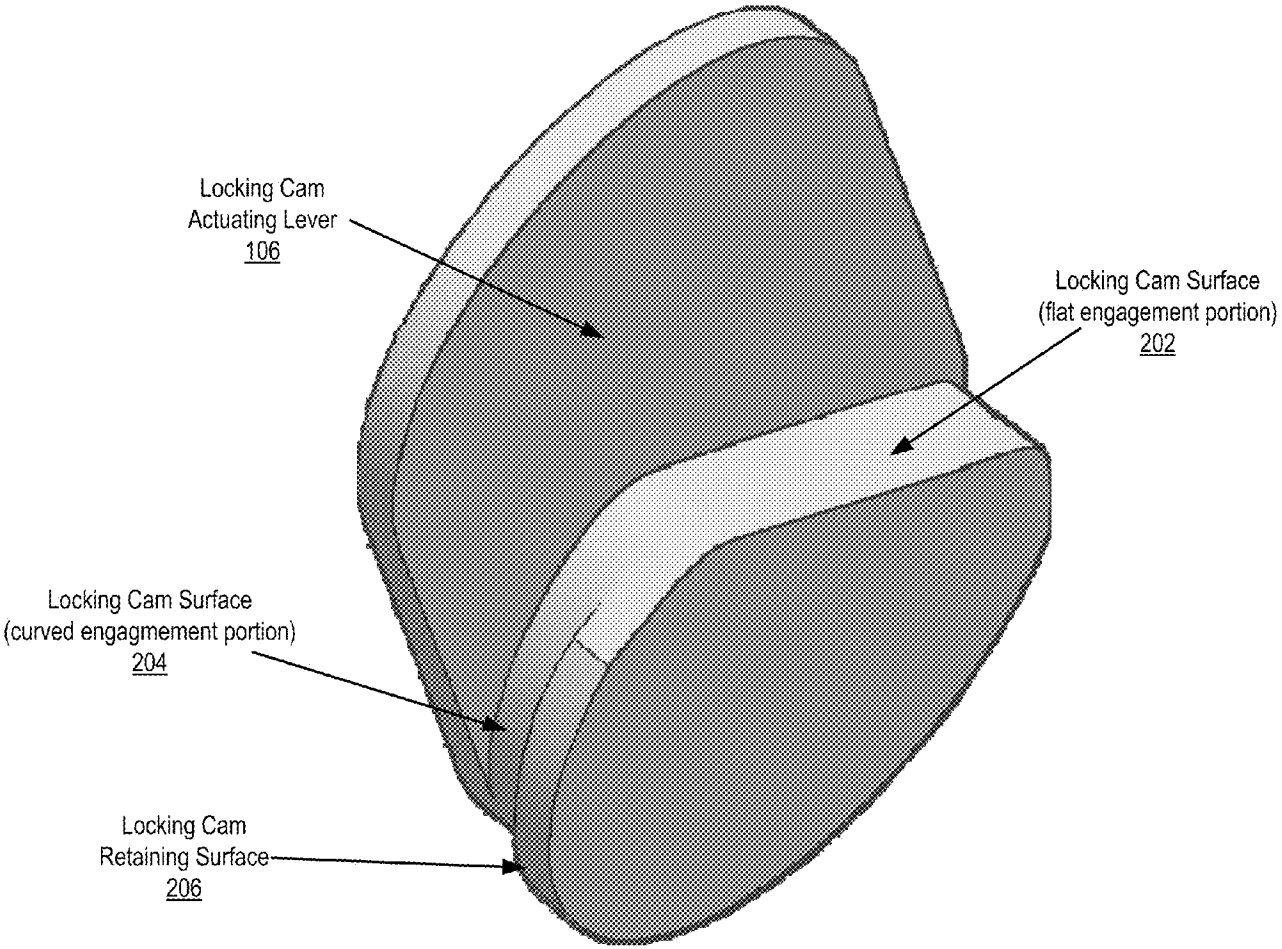
FIG. 2 sets forth a diagram of a locking cam and locking cam actuating lever of an example locking connector for engaging a USB receptacle according to the present invention.
Figure 6:
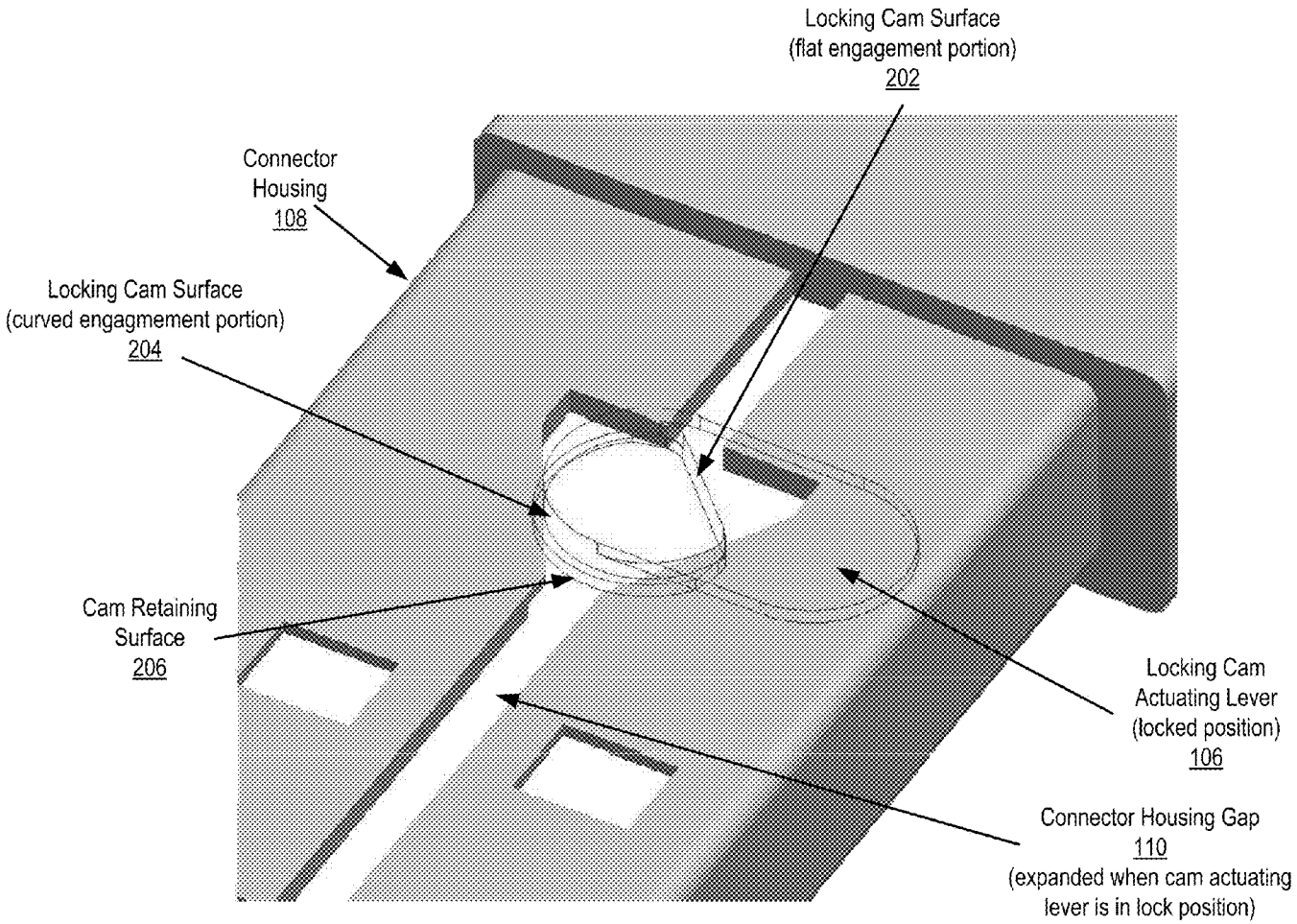
FIG. 6 sets forth a diagram of an example embodiment of a locking connector for engaging a USB receptacle according to the present invention in which the locking cam actuating lever is in the locked position.

Referring now to FIG. 2, the locking cam actuating lever (106) is connected to a locking cam surface. The locking cam surface includes two portions as shown in FIG. 2: a curved engagement surface (204) of the locking cam surface and a flat engagement surface (202) of the locking cam surface. The example embodiment of FIG. 2 further includes a cam retaining surface connected to the bottom of the locking cam surface. The cam retaining surface (206) is disposed within the connector housing, as shown in FIGS. 4 and 6, and positioned to secure the locking cam surface and locking cam actuating lever (106) to the locking connector (100).

Figure 3:
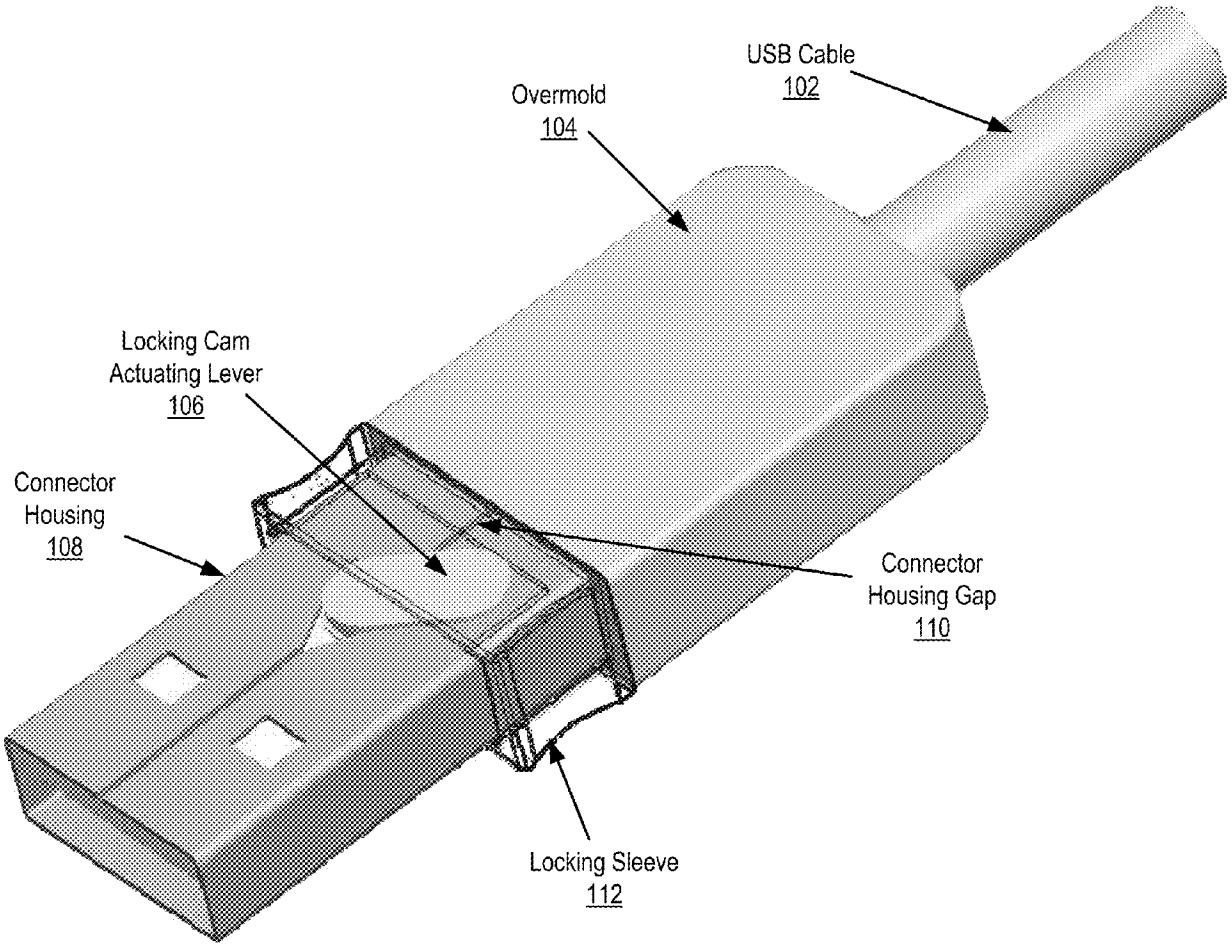
FIG. 3 sets forth a diagram of an example embodiment of a locking connector for engaging a USB receptacle according to the present invention in which the locking cam actuating lever is in the relaxed position.
Figure 5:
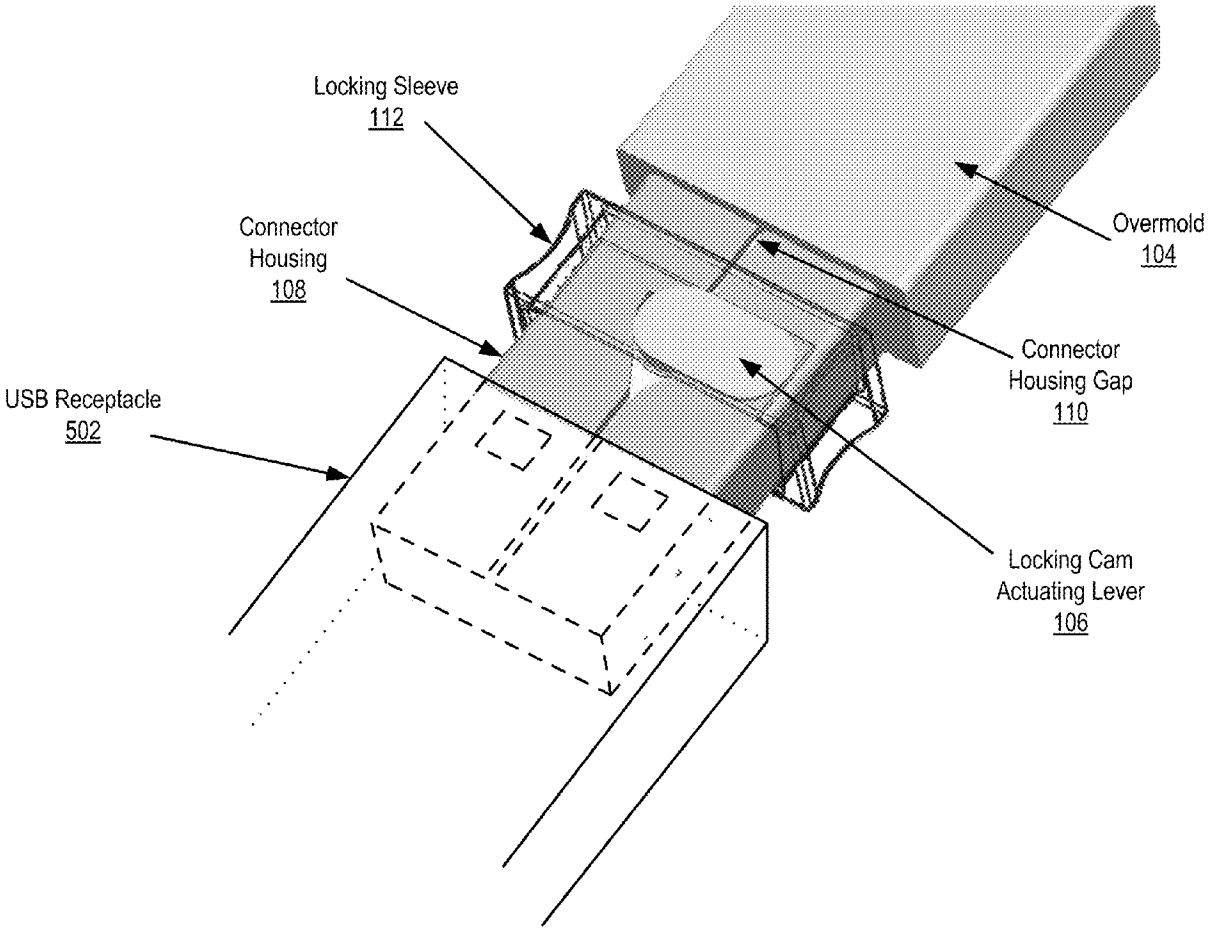
FIG. 5 sets forth a diagram of an example embodiment of a locking connector for engaging a USB receptacle according to the present invention in which the locking cam actuating lever is in the locked position.

Referring again to FIG. 1, locking connector 100 further includes a locking sleeve (112). Referring now to FIG. 3, when assembled onto the locking connector (100), the locking sleeve (112) is slideable along the longitudinal axis (116) of the locking connector (100) and is positioned around the housing connector (108) in contact with the locking cam actuating lever (106). The locking sleeve (112) is positioned such that sliding the locking sleeve (112) along the longitudinal axis (116) of the locking connector (100) toward the overmold (104) positions the locking sleeve (112) in a first position and the locking cam actuating lever (106) in the unlocked position, and sliding the locking sleeve (112) toward the USB receptacle (as shown in FIG. 5) positions the locking sleeve (112) in a second position and the locking cam actuating lever (106) in the locked position. FIG. 3 shows the assembled locking connector (100) with the locking sleeve (112) and locking cam actuating lever (106) in the unlocked position.

Figure 4:
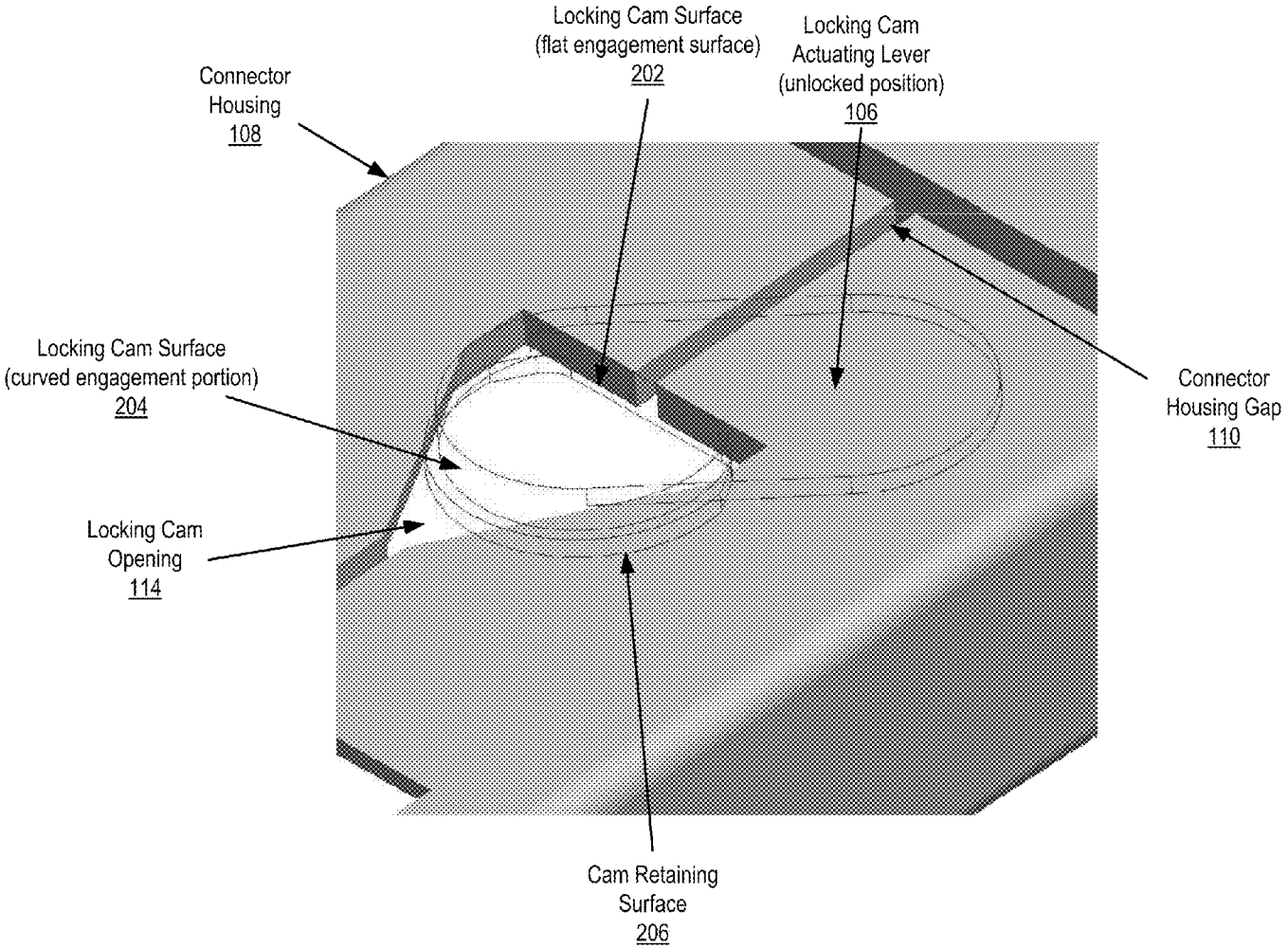
FIG. 4 sets forth a diagram of an example embodiment of a locking connector for engaging a USB receptacle according to the present invention in which the locking cam actuating lever is in the relaxed position.

FIG. 4 shows a closer view of the example locking connector (100) in the unlocked position as shown in FIG. 3, with the locking slide (112) removed for convenient reference to the locking cam mechanism. In FIG. 4, the locking cam actuating lever (106) is in the unlocked position. The locking cam surface is positioned within the locking cam opening (114) in contact with the connector housing (108) in a "relaxed" position. That is, the flat engagement surface (202) portion of the locking cam surface is positioned in contact with the connector housing (108) at the shortest "top" side of the triangular locking cam opening (114). The curved engagement surface (204) portion of the locking cam surface is positioned in contact with both of the remaining "angled" sides of the triangular locking cam opening. In this configuration, the connector housing (108) and connector housing gap (110) remain in a relaxed, unexpanded state. In the example embodiment of FIG. 4, the unexpanded connector housing gap (110) is about 0.4 millimeters wide.

FIG. 5 shows the assembled locking connector (100) engaged partially within a USB receptacle (502), with the locking sleeve (112) and locking cam actuating lever (106) in the locked position. In this configuration, the connector housing gap (110) is expanded and the sides of connector housing (108) are forced slightly outward, increasing friction between the connector housing (108) and the inside of USB receptacle (502).

FIG. 6 shows a closer view of the example locking connector (100) in the locked position as shown in FIG. 5, with the locking slide (112) removed for convenient reference to the locking cam mechanism. In FIG. 6, the locking cam actuating lever (106) is in the locked position. The locking cam surface is positioned within the locking cam opening (114) in contact with the connector housing (108) in a "rotated" position. That is, the curved engagement surface (204) portion of the locking cam surface is positioned in contact with all three sides of the triangular locking cam opening. In this configuration, locking rotated locking cam surface expands the connector housing gap (110) and connector housing (108), increasing friction between the connector housing (108) and the USB receptacle (502). In the example embodiment of FIG. 6, the connector housing gap (110) is about 1.2 millimeters wide in its expanded state.

Figure 7:
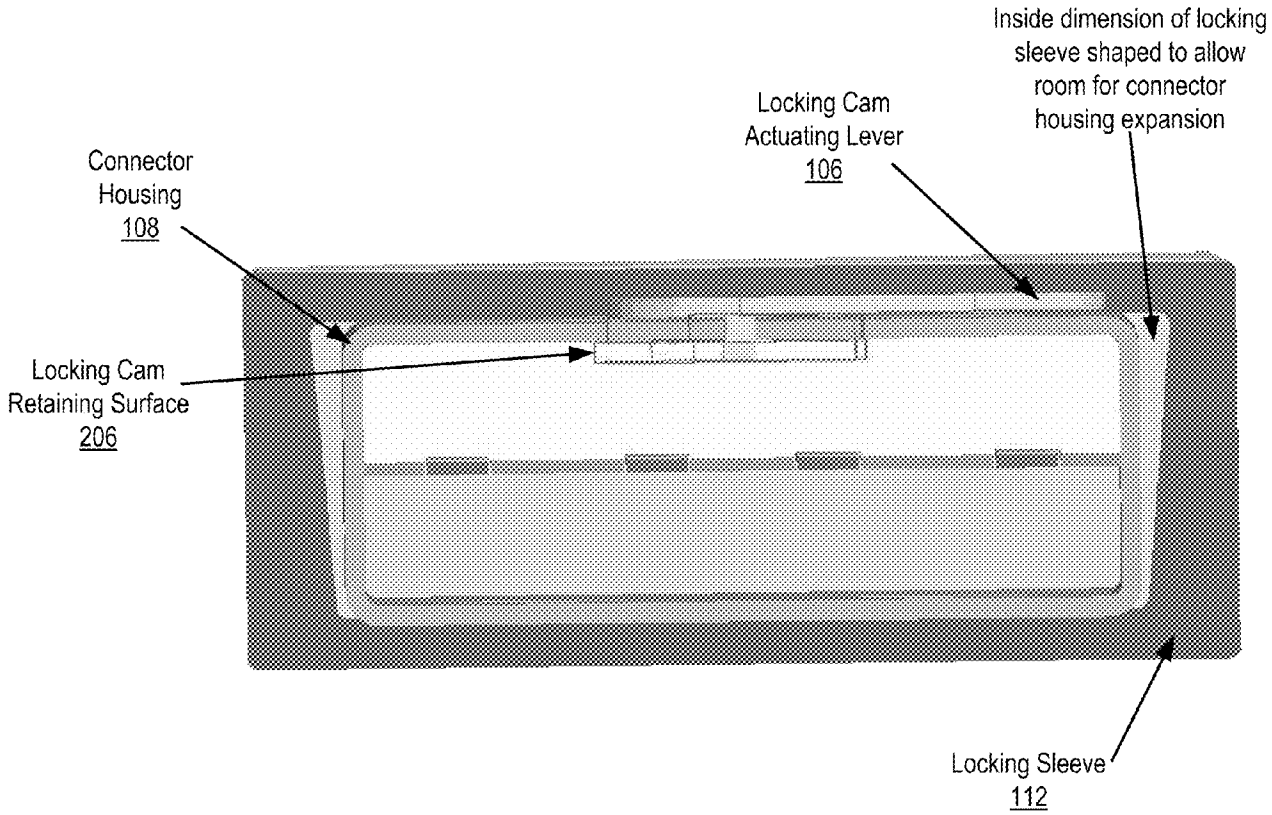
FIG. 7 sets forth a diagram of an example embodiment of a locking connector for engaging a USB receptacle according to the present invention.

FIG. 7 shows a view of the end of the example locking connector (100). The inside opening of the locking sleeve (112) is wider at one side to accommodate the expansion of the connector housing (108) when the locking connector (100) is in the locked state. The locking cam retaining surface 206 is disposed within the connector housing (108) and connected to the locking cam surface and locking cam actuating lever (106) to hold the locking cam surface and locking cam actuating lever (106) in place on the locking connector (100).

Figure 8:
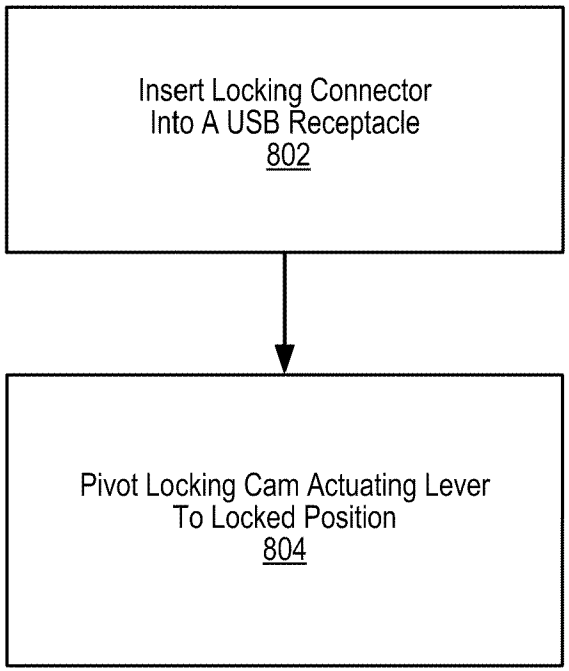
FIG. 8 sets forth a flow chart illustrating an example method of operating a locking connector for engaging a USB receptacle according to the present invention.

For further explanation, FIG. 8 sets forth a flow chart illustrating an example method for locking a USB device according to the present invention. The method of FIG. 8 includes inserting (802) a locking connector into a USB receptacle. Inserting (802) a locking connector into a USB receptacle may be carried out using a locking USB connector attached to a USB cable or jump drive and inserting the locking USB connector into any USB receptacle capable of receiving a USB connector. The method of FIG. 8 further includes pivoting (804) a locking cam actuating lever to a locked position. Pivoting the locking cam actuating lever may be carried out by a person using one or more fingers to pivot the locking cam actuating lever, and in other ways as will occur to those of skill in the art.

Figure 9:
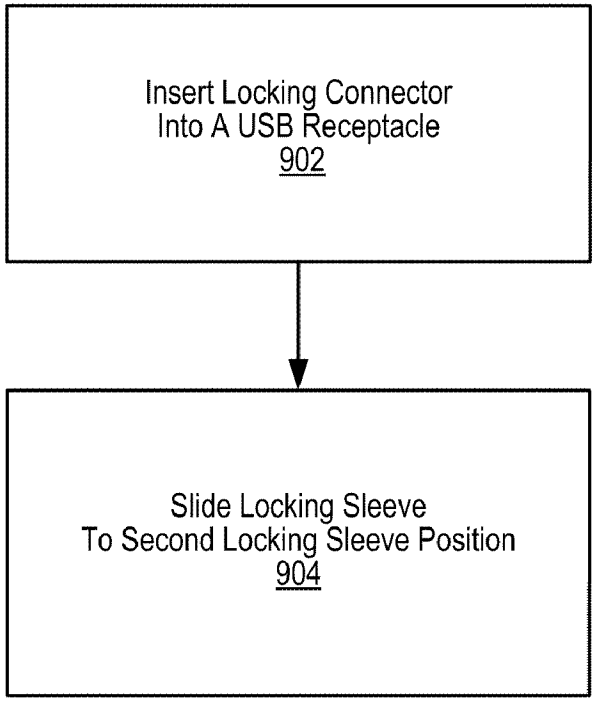
FIG. 9 sets forth a flow chart illustrating an additional example method of operating a locking connector for engaging a USB receptacle according to the present invention.

For further explanation, FIG. 9 sets forth a flow chart illustrating an additional example method for locking a USB device according to the present invention. The method of FIG. 9 includes inserting (902) a locking connector into a USB receptacle. As in the embodiment of FIG. 8, inserting (902) a locking connector into a USB receptacle may be carried out using a locking USB connector attached to a USB cable or jump drive and inserting the locking USB connector into any USB receptacle capable of receiving a USB connector. The method of FIG. 9 further includes sliding (904) a locking sleeve to a second, or "locked," locking sleeve position. Sliding the locking sleeve may be carried out by a person using one or more fingers to slide the locking sleeve along a longitudinal axis of the locking connector, and in other ways as will occur to those of skill in the art.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A locking connector for engaging a Universal Serial Bus ("USB") receptacle, the locking connector disposed partially within the USB receptacle, the locking connector comprising:

a connector housing having a locking cam opening on one side of the connector housing, the connector housing split along a longitudinal axis of the locking connector forming a connector housing gap on the same side of the connector housing as the locking cam opening;

a locking cam surface positioned within the locking cam opening in contact with the connector housing; and a pivotable locking cam actuating lever connected to a top of the locking cam surface, the locking cam actuating lever having a locked position and an unlocked position, the locking cam surface in a rotated position expanding the connector housing when the cam actuating lever is in the locked position, the locking cam surface in a relaxed position with the connector housing not expanded when the cam actuating lever is in the unlocked position.

2. The locking connector of claim 1, further comprising a slideable locking sleeve, the locking sleeve positioned around the connector housing in contact with the locking cam actuating lever, the locking sleeve further positioned to slide along the longitudinal axis of the locking connector between a first locking sleeve position and a second locking sleeve position, the locking cam actuating lever in the unlocked position when the locking sleeve is in the first locking sleeve position and the locking cam actuating lever in the locked position when the locking sleeve is in the second locking sleeve position.

3. The locking connector of claim 2, the slideable locking sleeve further comprising a first inside dimension adjacent to a first side of the connector housing where the connector housing gap is located and a second inside dimension opposite the first inside dimension and adjacent to a second side of the connector housing opposite the first side of the connector housing, the first inside dimension wider than the second inside dimension to accommodate expansion of the first side of the connector housing.

4. The locking connector of claim 1, the locking cam surface further comprising a flat engagement surface and a curved engagement surface.

5. The locking connector of claim 4, the locking cam opening substantially the shape of an isosceles triangle, the curved engagement surface of the locking cam surface disposed in contact with the connector housing at the two equal sides of the locking cam opening and the flat engagement surface disposed in contact with the connector housing at the short side of the locking cam opening when the locking cam surface is in the relaxed position; and the curved engagement surface of the locking cam surface disposed in contact with the connector housing at three sides of the locking cam opening when the locking cam surface is in the rotated position.

6. The locking connector of claim 1 further comprising a cam retaining surface connected to a bottom of the locking cam surface, the cam retaining surface disposed within the connector housing and positioned to secure the locking cam surface and locking cam actuating lever to the locking connector.

7. The locking connector of claim 1, the connector housing having at least one textured surface for increasing friction between the connector housing and the USB receptacle.

8. The locking connector of claim 1, the connector housing gap approximately 0.4 millimeters when the locking cam actuating lever is in the unlocked position and the connector housing gap is approximately 1.2 millimeters when the locking cam actuating lever is in the locked position.

* * * * *